US006119393A

United States Patent [19]

Wourms et al.

[11] Patent Number: 6,119,393

[45] Date of Patent: Sep. 19, 2000

[54] WATER POND POTTED PLANT SUPPORT

[76] Inventors: Richard L. Wourms; Paul W. Kendall, both of 20634 Harvest Hill, Houston, Tex. 77073

[21] Appl. No.: 09/079,121

[22] Filed: May 14, 1998

[51] Int. Cl.[7] ..... A47G 7/04

[52] U.S. Cl. ..... 47/39; 47/45; 248/175

[58] Field of Search ..... 47/39, 44, 45, 47/47, 66.3, 67, 904; 248/175, 318

[56] References Cited

U.S. PATENT DOCUMENTS

| | | | |
|---|---|---|---|
| D. 237,814 | 11/1975 | Edmonds, Jr. et al. | D11/152 |
| 240,891 | 5/1881 | Cook | 220/743 |
| 1,484,403 | 2/1924 | Miller | 47/67 |
| 1,688,846 | 10/1928 | Andrews | 210/464 |
| 2,318,930 | 5/1943 | Dietrich | 211/119 |
| 3,013,758 | 12/1961 | Smith | 248/153 |
| 3,088,245 | 5/1963 | Menge | 47/47 |
| 5,050,339 | 9/1991 | Howell | 47/39 |
| 5,390,443 | 2/1995 | Emalfarb et al. | 47/67 |
| 5,595,019 | 1/1997 | Foreman | 47/47 |

FOREIGN PATENT DOCUMENTS

| | | | |
|---|---|---|---|
| 1257504 | 5/1960 | France | 47/39 P |

*Primary Examiner*—Robert P. Swiatek
*Assistant Examiner*—Son T. Nguyen
*Attorney, Agent, or Firm*—Kenneth A. Roddy

[57] ABSTRACT

A water pond potted plant support for supporting a potted plant in a body of water contained in an enclosure. The support has at least one horizontal circular pot receiving ring member configured to encircle a pot containing a potted plant and support it in an upright position adjacent to a surface of the enclosure at a selected depth beneath the top surface of the body of water. In one embodiment, the support has a horizontal circular base ring supported on a horizontal surface of the enclosure, a lower circular ring smaller in diameter than the diameter of the base ring, an intermediate circular ring, and an upper circular ring smaller in diameter than the intermediate circular ring connected in vertically spaced relation by a plurality of rod elements secured therebetween in circumferentially spaced relation and a bail pivotally connected to the upper ring. A removable crossmember having a plurality of radially extending arms with downturned ends can be placed on either the lower ring or intermediate ring to support the potted plant and selectively position it relative to the horizontal surface and to the top surface of the body of water. In another embodiment the support has a crossmember with radially extending arms disposed a distance beneath the pot receiving ring and a pair of suspension rods connected to a side of the pot receiving ring that can be manually bent and shaped to engage a top edge of the enclosure to selectively position the potted plant adjacent to the enclosure side wall at a selected distance beneath the top surface of the body of water.

1 Claim, 3 Drawing Sheets

WATER POND POTTED PLANT SUPPORT

BACKGROUND OF THE INVENTION

1. Field of the Invention

This invention relates generally to plant stands, supports and baskets, and more particularly to water pond potted plant supports for use in water ponds for supporting water pond plants at selected depths in the water.

2. Brief Description of the Prior Art

Conventional water ponds and water gardens are made by digging a hole into the ground to a depth of approximately 18 to 24 inches to accommodate various plants and in some cases approximately 36 inches to accommodate ornamental fish. In some pond installations, one or more shelves are formed in the side wall of the excavation for supporting particular types of water plants which are planted in pots, and then the excavation is lined with a flexible protective liner of rubber or other suitable material. Various varieties of plants contained in pots are placed on the bottom of the pond and on the shelf The shelf which supports the potted plants are typically 10" to 12" deep and 10" to 12" wide and are sometimes angled slightly rearward and downward from the front edge to prevent the pots from sliding off into the pond.

In other pond installations, the excavation does not include the shelf formed in the side wall, and a rigid plastic or rubber tub is placed into the excavation. While some types of plants contained in pots may be placed on the bottom of the tub, it is necessary to support those that require a more shallow depth by any means at hand. Commonly, bricks, boards, cinder blocks, or milk crates are placed on the bottom of the tub and may be stacked to achieve the recommended depth.

Common type of plants used in water ponds and water gardens include deep water plants and marginal plants or bog plants. Deep water plants such as lilies are recommended to be placed 8 to 16 inches below the water. These types of plants grow from a tuber and form an elongate plant that extends well above the water surface. It is recommended that tropical lilies be planted 12 to 16 inches below the water. Bog plants such as cattails, horsetails, and rushes live in the shallows of the pond and their pots are placed on the shelves 8 to 16 inches below the water or supported on stacked bricks, boards, cinder blocks, or milk crates to achieve the recommended depth. These type of plants may grow anywhere from a foot to about 8 feet and thus also extend well above the water surface.

When water plants are planted in the pots, the soil stops about 2 inches from the top of the pot and the top of the soil is covered with an approximately 1" layer of stones and/or gravel to prevent the soil from floating and to prevent fish from digging into the soil.

Because these upper portions of these types of water plants extend well above surface of the water and the pots in which they are planted are a relatively shallow distance below the water surface, they frequently will blow over or slide off the support shelf or supporting bricks, boards, cinder blocks, or milk crates. This also causes the stones and gravel to spill into the pond and allows the potting soil to become dislodged and float in the water. Thus, the caretaker must often wade into the water to place the plants back into the upright position, and to retrieve the stones and gravel. Sometimes it is necessary to repot the plant.

The water plants must also be removed from the pond in order to clean the liner or tub periodically. Because the conventional pot containers do not have a handle or bail, the caretaker must wade into the water and grasp the pot to remove the plants.

The makeshift height adjusting bricks, boards, cinder blocks, or milk crates, and other supports and stands having legs or sharp corners can puncture the pond liner and cause leaks. There are several patents which disclose various plant stands, none of which are suitable for use in a water pond.

Howell, U.S. Pat. No. 5,050,339 discloses a plant stand for nursery shrubs having a larger base ring and a vertically spaced smaller ring which prevents the plant from tipping over in strong winds. However, there is no provision nor suggestion of any means for placing a potted plant a selected distance beneath a water surface.

Glamos, U.S. Pat. No. 5,174,060 discloses a plant stand having metal rod legs which are driven into the ground and encircled by helically coiled wire with a circular ring at each end. However, this stand is narrower at the bottom than at the top and there is no provision nor suggestion of any means for placing a potted plant a selected distance beneath a water surface.

Hillestad, U.S. Pat. No. 5,179,799 discloses a demountable tomato plant stand having metal rods which are driven into the ground and a plurality of vertically spaced circular rings. However, this stand is narrower at the bottom than at the top and there is no provision nor suggestion of any means for placing a potted plant a selected distance beneath a water surface.

The following design patents disclose ornamental designs for potted plant stands which are formed of wire rings and rods, but have no provision for placing a potted plant a selected distance beneath a water surface: Des Pat. No. 245,136; Des Pat. No. 343,968; Des Pat. No. 350,081; Des Pat. No. 362,762; Des Pat. No. 365,700; Des Pat. No. 372,137; and Des Pat. No. 384,222.

The present invention is distinguished over the prior art in general, and these patents in particular by a water pond potted plant support for supporting a potted plant in a body of water contained in an enclosure. The support has at least one horizontal circular pot receiving ring member configured to encircle a pot containing a potted plant and support it in an upright position adjacent to a surface of the enclosure at a selected depth beneath the top surface of the body of water. In one embodiment, the support has a horizontal circular base ring supported on a horizontal surface of the enclosure, a lower circular ring smaller in diameter than the diameter of the base ring, an intermediate circular ring, and an upper circular ring smaller in diameter than the intermediate circular ring connected in vertically spaced relation by a plurality of rod elements secured therebetween in circumferentially spaced relation and a bail pivotally connected to the upper ring. A removable crossmember having a plurality of radially extending arms with downturned ends can be placed on either the lower ring or intermediate ring to support the potted plant and selectively position it relative to the horizontal surface and to the top surface of the body of water. In another embodiment the support has a crossmember with radially extending arms disposed a distance beneath the pot receiving ring and a pair of suspension rods connected to a side of the pot receiving ring that can be manually bent and shaped to engage a top edge of the enclosure to selectively position the potted plant adjacent to the enclosure side wall at a selected distance beneath the top surface of the body of water.

SUMMARY OF THE INVENTION

It is therefore an object of the present invention to provide a water pond potted plant support which will prevent plants from tipping over in strong winds.

It is another object of this invention to provide a water pond potted plant support which allows a variety of different water pond plants to be placed and supported a correct recommended distance beneath the water surface for optimum plant growth and beauty of each particular plant variety.

Another object of this invention is to provide a water pond potted plant support which allows water pond plants to be easily and quickly removed from the pond without requiring the caretaker to wade in the pond.

Another object of this invention is to provide a water pond potted plant support which will eliminate the need for unsightly bricks, boards, cinder blocks, and milk crates to support plants.

Another object of this invention is to provide a water pond potted plant support which will eliminate the need to provide a shelf in the side wall of the pond to support plants.

A further object of this invention is to provide a water pond potted plant support which will elevate the plant pot a distance above the bottom of the pond to serve as a cover for fish.

A still further object of this invention is to provide a water pond potted plant support which is simple in construction and inexpensive to manufacture.

Other objects of the invention will become apparent from time to time throughout the specification and claims as hereinafter related.

The above noted objects and other objects of the invention are accomplished by a water pond potted plant support for supporting a potted plant in a body of water contained in an enclosure. The support has at least one horizontal circular pot receiving ring member configured to encircle a pot containing a potted plant and support it in an upright position adjacent to a surface of the enclosure at a selected depth beneath the top surface of the body of water. In one embodiment, the support has a horizontal circular base ring supported on a horizontal surface of the enclosure, a lower circular ring smaller in diameter than the diameter of the base ring, an intermediate circular ring, and an upper circular ring smaller in diameter than the intermediate circular ring connected in vertically spaced relation by a plurality of rod elements secured therebetween in circumferentially spaced relation and a bail pivotally connected to the upper ring. A removable crossmember having a plurality of radially extending arms with downturned ends can be placed on either the lower ring or intermediate ring to support the potted plant and selectively position it relative to the horizontal surface and to the top surface of the body of water. In another embodiment the support has a crossmember with radially extending arms disposed a distance beneath the pot receiving ring and a pair of suspension rods connected to a side of the pot receiving ring that can be manually bent and shaped to engage a top edge of the enclosure to selectively position the potted plant adjacent to the enclosure side wall at a selected distance beneath the top surface of the body of water.

DESCRIPTION OF THE PREFERRED EMBODIMENT

Figure 1:
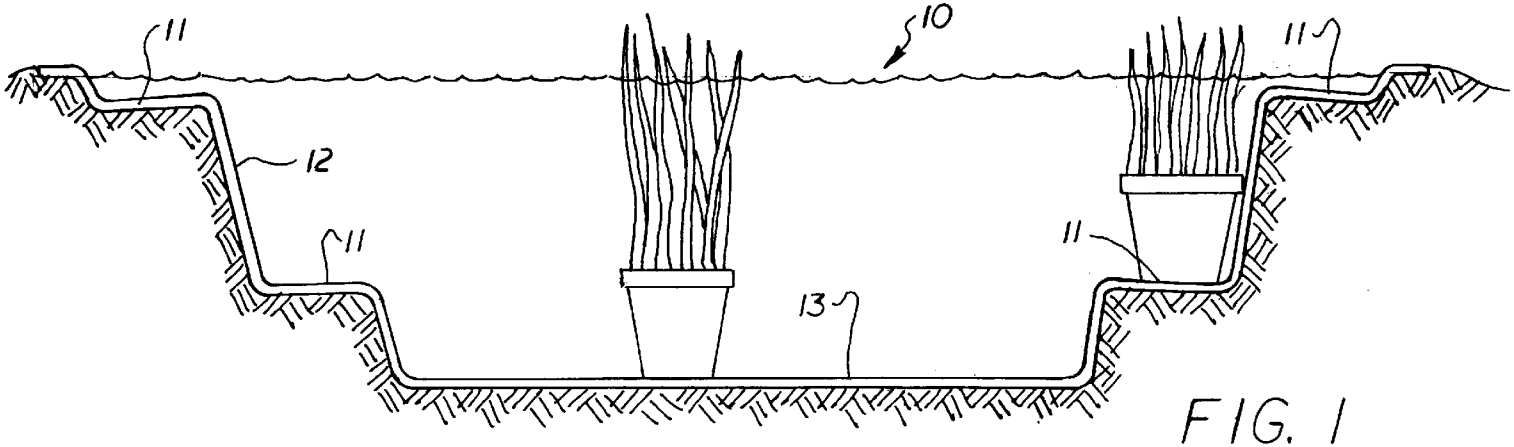
FIG. 1 (PRIOR ART)
FIG. 1 is a cross sectional view of a conventional water pond of the prior art having a shelf formed in the side wall of the pond

Referring to the drawings by numerals of reference, a conventional water pond 10 of the prior art is shown in cross section. In the illustrated example, one or more shelves 11 are formed in the side wall of the excavation for supporting particular types of water plants which are planted in pots, and the excavation is lined with a flexible protective liner 12 of rubber or other suitable material. Various varieties of plants contained in pots are placed on the bottom 13 of the pond and on the shelves 11.

Figure 2:
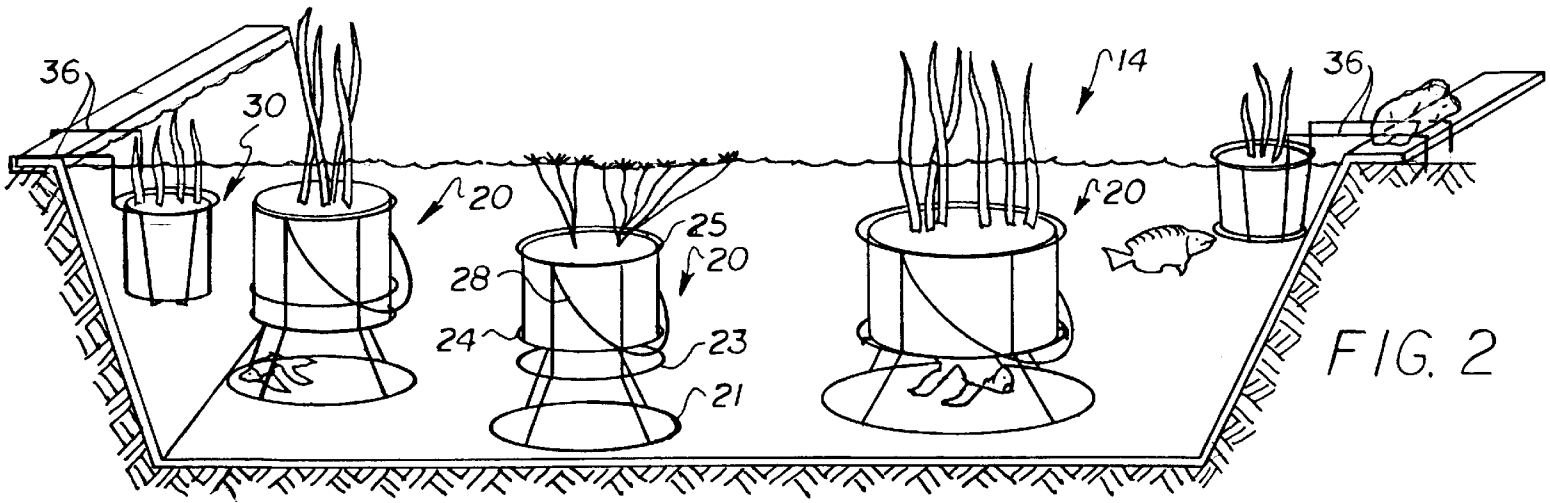
FIG. 2 is a cross sectional view of a water pond having no shelf formed in the side wall and showing the water plants supported by the water pond potted plant supports in accordance with the present invention.

FIG. 2 shows in cross section, a water pond 14 having no shelf and wherein the water plants are shown supported by the water pond potted plant supports 20 and 30 in accordance with the present invention.

Figure 3:
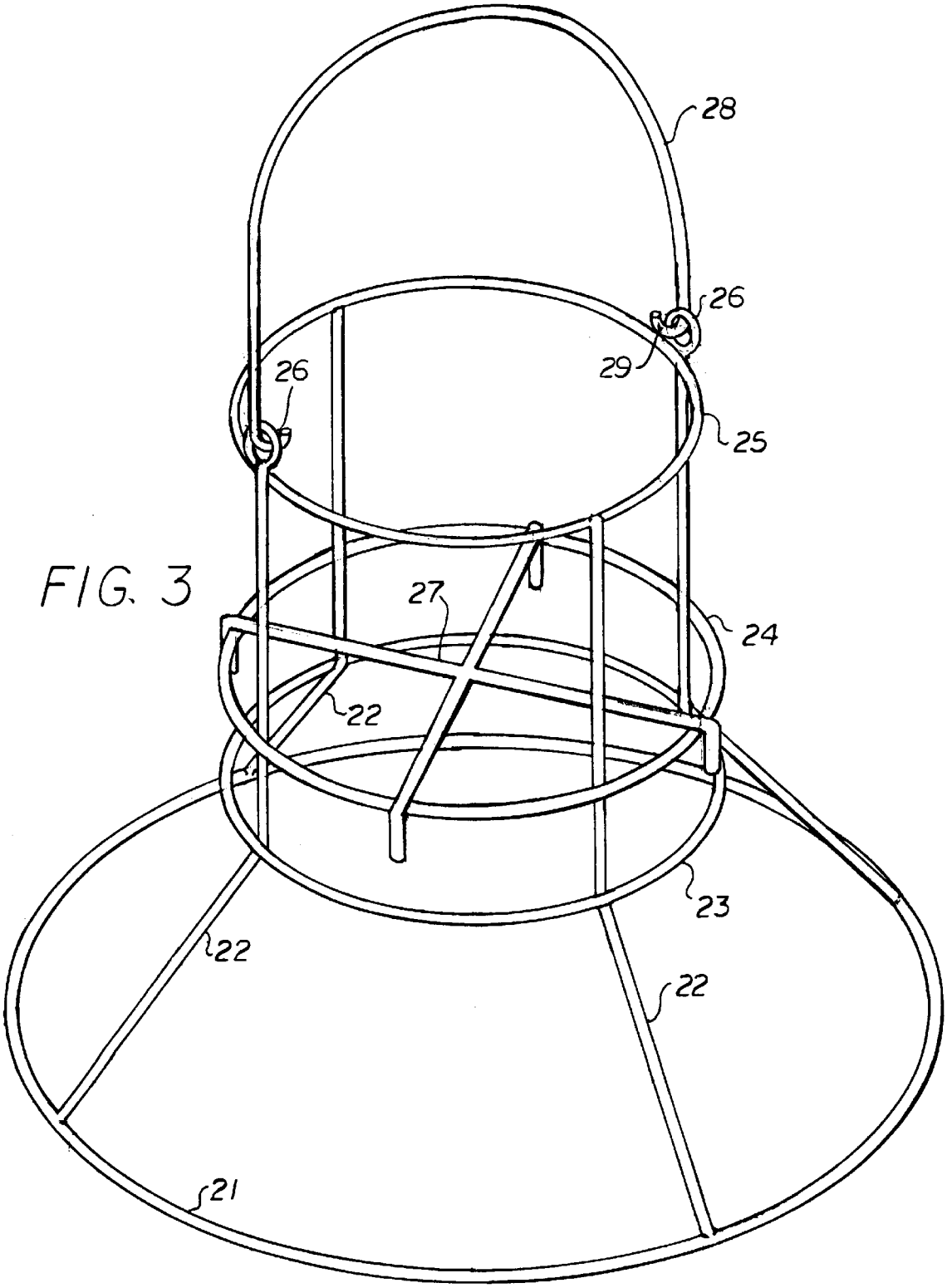
FIG. 3 is a perspective view of a water pond potted plant support which may be supported on the bottom of the water pond.

Referring now to FIG. 3, there is shown a preferred embodiment of a water pond potted plant support 20 which may be supported on the bottom of the water pond. The support 20 includes a larger circular base ring 21 and a plurality of elongate rods 22 secured at their bottom ends to the base ring in circumferentialy spaced relation and extending angularly upward and inward from the base ring. A plurality of smaller circular rings 23, 24, and 25 are secured to the upwardly extending rods 22 a vertically spaced distance apart and a distance above the base ring. Two of the diametrically opposed rods 22 extend a distance above the uppermost ring 25 and their terminal ends are bent to form a loop or eyelet 26.

A removable shelf 27 is formed of wire rods joined at their center and extending radially outward from the center with their outer ends bent perpendicularly downward. The removable shelf 27 is sized to be supported horizontally on either of the intermediate rings 23 or 24 and span the opening of the selected ring to receive and support the bottom of a conventional plant pot.

A handle or bail 28 is formed of wire rod bent into a generally semicircular shape with its outer ends bent inwardly and upwardly in a generally J-shaped hook 29. The hooked ends 29 of the bail 28 are received through the diametrically opposed eyelets 26, such that the bail can pivot about the eyelets between a lowered position adjacent the periphery of the intermediate rings 23 and 24 and a raised position extending vertically upward above the uppermost ring 25.

The base ring 21 is dimensioned to provide a wide support base for a potted plant supported on the removable shelf 27 and prevent the plant from tipping over in strong winds. The intermediate rings 23 and 24 are dimensioned to encircle the intermediate portion of the plant pot. The uppermost ring 25 is dimensioned to encircle the top portion or rim of the conventional plant pot. It should be understood that in some installations, the shelf 27 may be removed and the plant pot suspended from the uppermost ring by supporting the rim of the pot on the uppermost ring 25.

In a preferred embodiment, the base ring 21 is from about 20" to about 24" in diameter, the intermediate rings 23 and 24 are from about 10¼" to about 17" in diameter, and the uppermost ring 25 is from about 10¼" to about 16½" in diameter. The vertical height of the support 20 may be from about 16" to about 22" from the base ring 21 to the uppermost ring 25. The upper intermediate ring 24 is preferably spaced a distance of about 7" below the uppermost ring 25. The lower intermediate ring 23 is preferably spaced a distance of from about 10" to about 12" below the uppermost ring 25.

Referring again to FIG. 2, when the support 20 is placed on the bottom of the pond, the uppermost ring 25 will be beneath the surface of the water, and the removable shelf may be placed on the appropriate intermediate ring 23 or 24 to support the pot of the plant at or about the distance beneath the water surface recommended for the particular plant variety.

When it becomes necessary to remove the potted water plant, the caretaker can easily remove the supports 20 containing the potted plants located near the edge of the pond by grasping the bail 28 by hand and lifting it out of the water. The plants contained in supports 20 located near the center of the pond can be easily removed by engaging the bail 28 with the end of a pole, hoe, or rake and lifting it out of the water.

Figure 4:
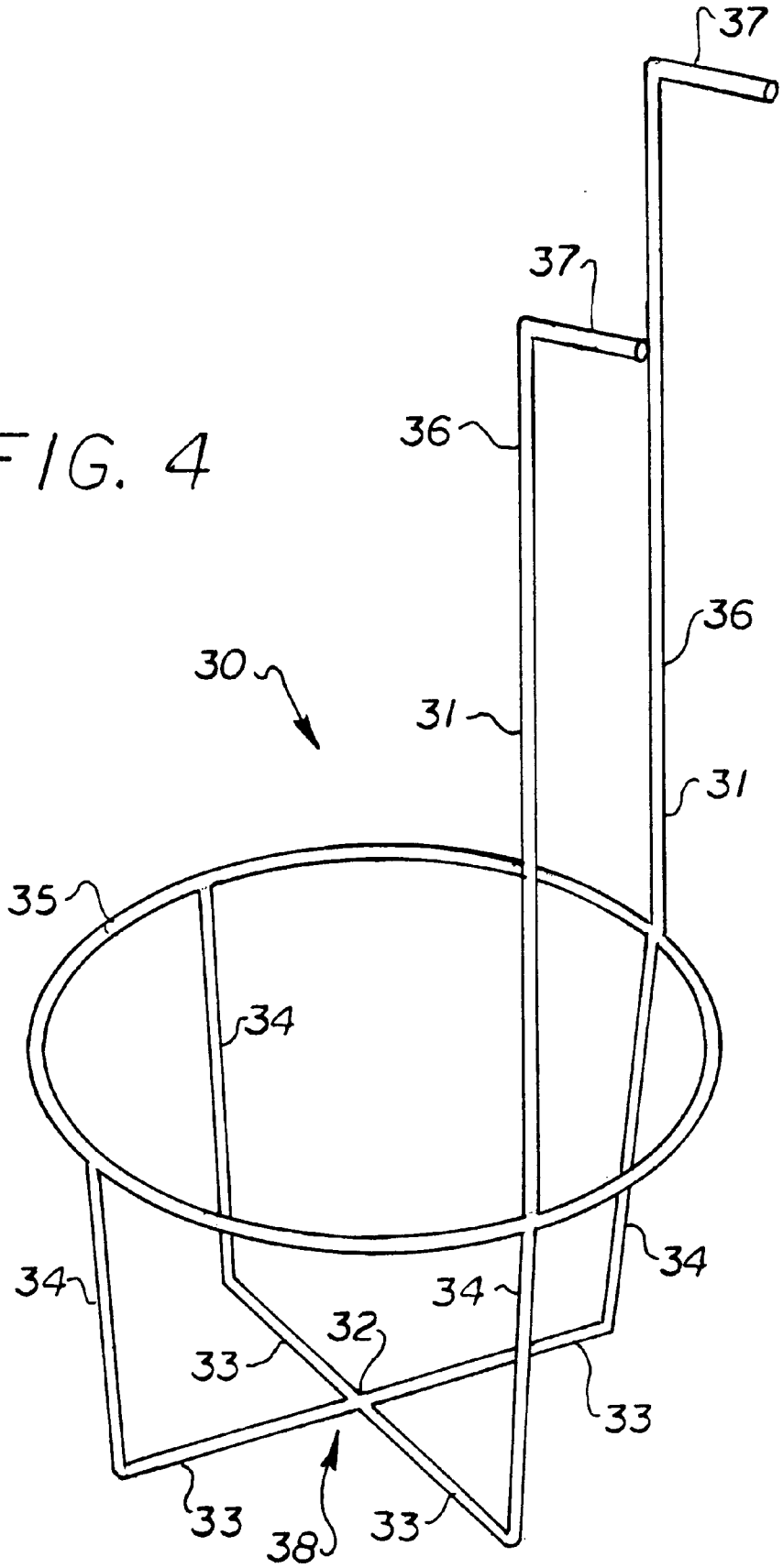
FIG. 4 is a perspective view of a water pond potted plant support which may be supported on the top edge of the water pond.

Referring now to FIG. 4, there is shown a preferred embodiment of a water pond potted plant support 30 which may be supported on the top edge of the water pond. The support 30 includes a pair of elongate wire rods 31 secured together to form a cross-shaped central juncture 32 and radial portions 33 extending horizontally outward a distance from the central juncture. The rods 31 are bent to extend angularly upward and outward 34 from the end of the horizontal radial portions 33. A ring 35 is secured horizontally to the upwardly extending portions 34 of the rods 31 and is vertically spaced a distance above the horizontal radial portions 33.

Two of the adjacent rods 31 extend a distance vertically above the ring 35 to form a vertical portion 36 and their terminal ends are bent to form a short perpendicular portion 37. The wire rods 31 are sufficiently bendable such that the vertical portions 36 may be bent by hand as explained hereinafter. The cross-shaped central juncture 32 and horizontal radial portions 33 form a shelf 38 a distance below the ring 35 for receiving and supporting the bottom of a conventional plant pot. The ring 35 is dimensioned to encircle the upper portion of the conventional plant pot.

In a preferred embodiment, the ring 35 is from about 8" to about 10" in diameter, the radial horizontal portions are from about 6½" to about 8½" in length, and the vertical portions 36 above the ring 35 are about 17" to 18" in length. The vertical height of the support 20 may be about 23" to 24" in length from the bottom to the top. The ring 35 is preferably spaced a distance of from about 5¼" to about 7" above the horizontal radial portions 33 of the shelf 38.

Referring again to FIG. 2, the support 30 may be secured to the upper edge of the pond tub by bending the vertical portions 36 to fit over the peripheral lip of the tub, as seen in the left hand side of the figure, or as shown on the right hand side of the figure, the vertical portions 36 of the rods 31 may be bent to fit over the peripheral lip of the tub and their outer ends driven into the ground. A large ornamental stone or other heavy object may be placed on the bent portion of the rods 31 that extends over the peripheral lip of the tub to further secure the support against movement.

The vertical portions 36 of the rods 31 are bent at a distance above the ring 35 such that a potted plant supported in the support will be positioned at or about the distance beneath the water surface recommended for the particular plant variety.

When it becomes necessary to remove the potted water plant, the caretaker can easily remove the supports 30 containing the potted plants by grasping the bent portion overlapping the peripheral lip of the tub and by hand and lifting it out of the water.

Another advantage of the present water pond plant supports are that they elevate the plant pot a distance above the bottom of the pond and thus provide a cover for fish. The supports may also be used for supporting a water pump to elevate the pump and prevent the pump from moving around in the pond While this invention has been described fully and completely with special emphasis upon a preferred embodiment, it should be understood that within the scope of the appended claims the invention may be practiced otherwise than as specifically described herein.

Although the support embodiments have been described by way of example as being constructed of wire rod, it should be understood that they may also be constructed or molded using different materials. For example, the embodiments of FIGS. 2 and 3 may be formed of an open frame configuration constructed of rigid plastic, similar in construction to a molded plastic milk crate, or a combination of molded plastic and wire rod elements.

What is claimed is:

1. A water pond potted plant support for supporting a potted plant beneath the top surface of a body of water contained in an enclosure having a horizontal surface beneath the top surface of the water, comprising:

a horizontal circular base ring having a diameter adapted to be received and supported on the horizontal surface of the enclosure a distance beneath the top surface of the water;

a lower horizontal circular ring having a diameter smaller than the diameter of said base ring, an intermediate horizontal circular ring having a diameter smaller than the diameter of said base ring, and a horizontal circular top ring disposed at the top end of said support having a diameter smaller than the diameter of said intermediate circular ring and sized to encircle a pot containing a potted plant and maintain said pot in an upright position;

a plurality of generally upright circumferentially spaced rigid rod elements secured between said base ring, said lower ring, said intermediate ring, and said top ring, to secure said base ring, said lower ring, said intermediate ring, and said top ring in vertically spaced relation; and a removable crossmember having a plurality of radially extending arms with downturned ends sized to be selectively and removably supported on either of said lower ring or said intermediate ring for receiving and supporting a bottom end of said pot containing the potted plant and selectively positioning said pot vertically relative to said horizontal surface and to the top surface of the body of water;

a pair of eyelets disposed at diametrically opposed sides of said top ring; and a bail having ends pivotally mounted in said eyelets for carrying said plant support and for placing it into and removing it from said body of water.

* * * * *